US009568276B2

(12) United States Patent
Jackson et al.

(10) Patent No.: US 9,568,276 B2
(45) Date of Patent: Feb. 14, 2017

(54) TILT-ACTIVATED LASER AIMED FIREARMS AMMUNITION

(71) Applicants: Charles Jerome Jackson, Beech Grove, AR (US); John C. McIntyre, Memphis, TN (US)

(72) Inventors: Charles Jerome Jackson, Beech Grove, AR (US); John C. McIntyre, Memphis, TN (US)

( * ) Notice: Subject to any disclaimer, the term of this patent is extended or adjusted under 35 U.S.C. 154(b) by 134 days.

(21) Appl. No.: 14/604,169

(22) Filed: Jan. 23, 2015

(65) Prior Publication Data

US 2016/0216067 A1 Jul. 28, 2016

(51) Int. Cl.
*F41G 3/26* (2006.01)
*F41G 1/35* (2006.01)
*F42B 5/02* (2006.01)

(52) U.S. Cl.
CPC . *F41G 1/35* (2013.01); *F42B 5/02* (2013.01); *F41G 3/26* (2013.01); *F41G 3/2616* (2013.01)

(58) Field of Classification Search
CPC ..... F41G 1/35; F41G 3/26; F41G 3/2616; F42B 5/02; F42B 5/08
USPC ..... 42/114–117
See application file for complete search history.

(56) References Cited

U.S. PATENT DOCUMENTS 2,773,309 A * 12/1956 Elliott ..... F41G 1/54 42/134
3,912,197 A * 10/1975 McKown ..... F41G 7/26 102/503
4,048,489 A 9/1977 Giannetti
5,365,669 A * 11/1994 Rustick ..... G01B 5/0023 33/DIG. 21
5,454,168 A * 10/1995 Langner ..... F41G 3/323 356/153
5,787,631 A * 8/1998 Kendall ..... F41A 33/02 42/116
6,389,730 B1 * 5/2002 Millard ..... F41A 33/02 42/116
7,905,043 B2 * 3/2011 Hopkins ..... F41G 1/35 102/430
7,947,937 B1 * 5/2011 Langner ..... F42B 15/01 102/501
8,443,542 B1 * 5/2013 Galbraith ..... F41G 1/08 42/113
8,544,203 B2 * 10/2013 Jackson ..... F41A 33/02 102/472
2001/0042335 A1 * 11/2001 Strand ..... F41A 33/02 42/116
2010/0011648 A1 * 1/2010 Hopkins ..... F41G 1/35 42/116
2012/0042560 A1 * 2/2012 Jackson ..... F41A 33/02 42/116

* cited by examiner

*Primary Examiner* — John D Cooper
(74) *Attorney, Agent, or Firm* — Eric B. Fugett; Waller Lansden Dortch & Davis, LLP

(57) ABSTRACT

Sighting devices and cartridges for a firearm comprising an internal sighting and aiming system which incorporates and leverages electromagnetic radiation as the means for aiming the firearm. The sighting and aiming system must first be placed in the chamber of a firearm to be functional. It is activated and deactivated by the angle at which the firearm is held.

8 Claims, 13 Drawing Sheets

TILT-ACTIVATED LASER AIMED FIREARMS AMMUNITION

BACKGROUND

The disclosure relates generally to firearms, including devices for aiming a firearm. More particularly, the disclosure relates to live ammunition containing a battery, a positional switch, and a laser module that emits electromagnetic radiation only when inserted in the chamber of a firearm held at a non-vertical working angle.

Firearms are traditionally aimed using iron or telescopic sights mounted parallel to the bore of the firearm. To use such sights, the firearm is brought to just below the line of sight and the sights engaged by the shooter's eye. Discharging the firearm while the sights are aligned with the target will theoretically guide the shot to the point of aim. Such sights facilitate accurate aiming and shot placement when properly lined up with the target because the bore of the firearm should be aligned with the target as well.

However, iron and telescopic sights are subject to several deficiencies that have plagued shooters through the years. For example, such sights may not be visible or useful in low light or dark environments, are prone to misalignment, and can be easily damaged or rendered useless by low-force impacts. Such sights can also be difficult and slow to align, which may be particularly detrimental to a shooter in a life-threatening or stressful situation. In such scenarios, even properly calibrated traditional sights are of little to no value. It is therefore common for shooters operating in combat, close quarters and life-threatening or otherwise stressful situations to completely ignore their sights. Instead, such shooters visually focus on the threat presented by an aggressor or other target and rely on a combination of instinct and hand-eye coordination to align the firearm with the target. Even so, most shooters statistically miss more than half of shots fired at an average distance of less than seven feet.

The same is also true in the case of shotguns, wherein the average distance of most shots is less than ten yards. This is due in part to the common but inaccurate assumption that shotgun pellets will spread to encompass whatever is within the shooter's vision. For this reason, many shooters often point a shotgun toward the target rather than aim, possibly even firing from below their line of sight. To the contrary, shot spreads approximately one inch per yard when fired from the muzzle of a shotgun. Thus, a target perceived as impossible to miss across a room at 21 feet may easily be missed by the seven-inch shot pattern.

Some more modern sighting systems rely on battery-powered laser devices to assist with aiming and shot placement. Such devices typically emit an extremely straight laser beam that is generally invisible from the sides and that culminates in a bright dot on the target. A shot fired from a weapon equipped with a properly installed laser device should theoretically contact the intended target at the point illuminated by the laser when fired.

Most laser-based sighting systems attach to the exterior of a firearm and are activated by the operator through various types of switches. These kinds of laser devices add weight, bulk and an additional layer of complexity to a firearm, all of which are undesirable and require additional time to navigate. Complexity tends to increase the chance of user error, delay, and risk of failure by interfering with normal firearm operation and slowing a shooter, particularly during high-stress situations. Moreover, such systems generally must be zeroed for accuracy before they can be used reliably. Although some light-weight, pre-zeroed laser-based sighting systems that allow for internal installation are available, such laser devices are costly, often require professional installation, and must be manually switched on or off as needed to preserve battery life and mask a shooter's location.

The present inventor's U.S. Pat. No. 8,544,203, the entire disclosure of which is hereby incorporated by reference herein, discloses a sighting device for firearms comprising a laser module, battery, and associated circuitry housed within a live ammunition cartridge that projects a bright dot of light out of the bore of a firearm directly onto the target. The device is installed and the laser simultaneously activated when the cartridge is chambered in a firearm designed to accept said cartridge. It requires no zeroing or additional training beyond basic firearm safety, adds no weight to a firearm, and is affordable to most firearms owners. Removing the device from the chamber of the firearm deactivates the laser. The device can be safely stored in the magazine of the firearm or separately from the firearm when not in use.

However, the device disclosed in U.S. Pat. No. 8,544,203 is not suited for continued storage in the chamber of a firearm because the laser will continue to emit visible light until the battery is exhausted or the cartridge is removed. The fact that the device must be removed from the chamber to deactivate the laser and preserve battery life makes it unsuitable for use in certain applications such as home defense where shooters prefer to store a firearm with a cartridge chambered in order to save time and thus lives.

This deficiency forces a shooter to choose between storing the firearm with a cartridge chambered or chambering a cartridge as needed. Neither option is desirable or acceptable. Storage of a firearm with the cartridge chambered risks that the battery will be depleted and the laser rendered useless before the firearm is needed. By contrast, chambering a cartridge on an as-needed basis risks exposure of the shooter to an adversary because the act of chambering a cartridge generally creates a distinctive audible noise that could reveal the position of a shooter as well as the fact that the shooter is armed. The extra step of chambering a cartridge in an emergency also unnecessarily slows target acquisition and thus limits the shooter's responsive capabilities.

Therefore, a need exists to provide an improved laser sighting system that can remain in the chamber of a firearm stored at the ready without negatively impacting battery life. Further, a need exists to provide an improved laser sighting system that can be automatically activated through a natural motion inherent to firearm use that does not require the shooter to manually operate a separate activation switch. Still further, a need exists to provide improved laser aimed firearms ammunition that can be reliably stored for prolonged periods loaded in the chamber of a firearm and silently activated without giving away a shooter's position.

SUMMARY

The present invention improves upon the instant inventor's U.S. Pat. No. 8,544,203. Embodiments disclosed herein relate to sighting devices for firearms and laser aimed firearms ammunition configured to emit electromagnetic radiation through the barrel of a firearm capable of holding said ammunition when inserted into the chamber of said firearm and only while the firearm is held within a certain working angle. A laser module housed within certain embodiments of the sighting devices and laser aimed firearms ammunition disclosed herein is configured to automatically activate when a firearm with a chambered cartridge is brought to a position within a certain working angle relative to the ground, and automatically deactivates when the firearm is brought to a near vertical position outside the working angle.

In accordance with one aspect, a sighting device for a firearm comprising a battery, positional switch, laser module, and associated circuitry housed within a live ammunition cartridge is provided.

Another aspect relates to a drop-in, self-contained laser sighting assembly for use in a standard, commercially available shotgun shell hull, said laser sighting assembly comprising an insert housing, a laser module, a spring, a positional switch, a battery, and electrically conductive battery and laser module contact strips, wherein said battery strip is in electrically conductive contact with said battery and said laser module strip is in electrically conductive contact with said laser module.

Still yet another embodiment relates to a generally cylindrical insert for use in the modification of a shotgun shell hull, comprising a shot chamber, a power supply chamber, a laser module chamber, and an internal, upwardly extending tubular member, said shot chamber and said power supply chamber being partitioned by a floor from which said tubular member extends, and said laser module chamber being contained within said tubular member.

These features overcome the deficiencies of the prior art to provide a shooter the option of storing in the chamber of a suitable firearm a live ammunition cartridge containing an integral, tilt-activated laser which is activated automatically by movement of said firearm into a natural shooting position. The fact that a user may deactivate the laser while the cartridge is present in the chamber of the firearm by merely holding the firearm within a certain angle relative to vertical provides markedly increased user convenience, defensive capabilities, firearm utility, and dramatically extends the life of the integral battery. The sighting devices and laser aimed ammunition disclosed herein also afford shooters a greater advantage in defensive situations by virtue of the fact that a cartridge may be reliably stored in the chamber of a firearm and the laser silently and automatically activated by simply lowering the firearm to a natural shooting position without the need to manually actuate a separate switch.

Other objects and advantages will become apparent from the following disclosure.

BRIEF DESCRIPTION OF THE DRAWINGS

The foregoing summary, as well as the following detailed description, may be better understood when read in conjunction with the appended drawings. For the purpose of assisting in the explanation of the invention, there are shown in the drawings representative embodiments which are considered illustrative. It should be understood, however, that the invention is not limited in any manner to the precise arrangements and instrumentalities shown.

In the drawings.

Figure 1:
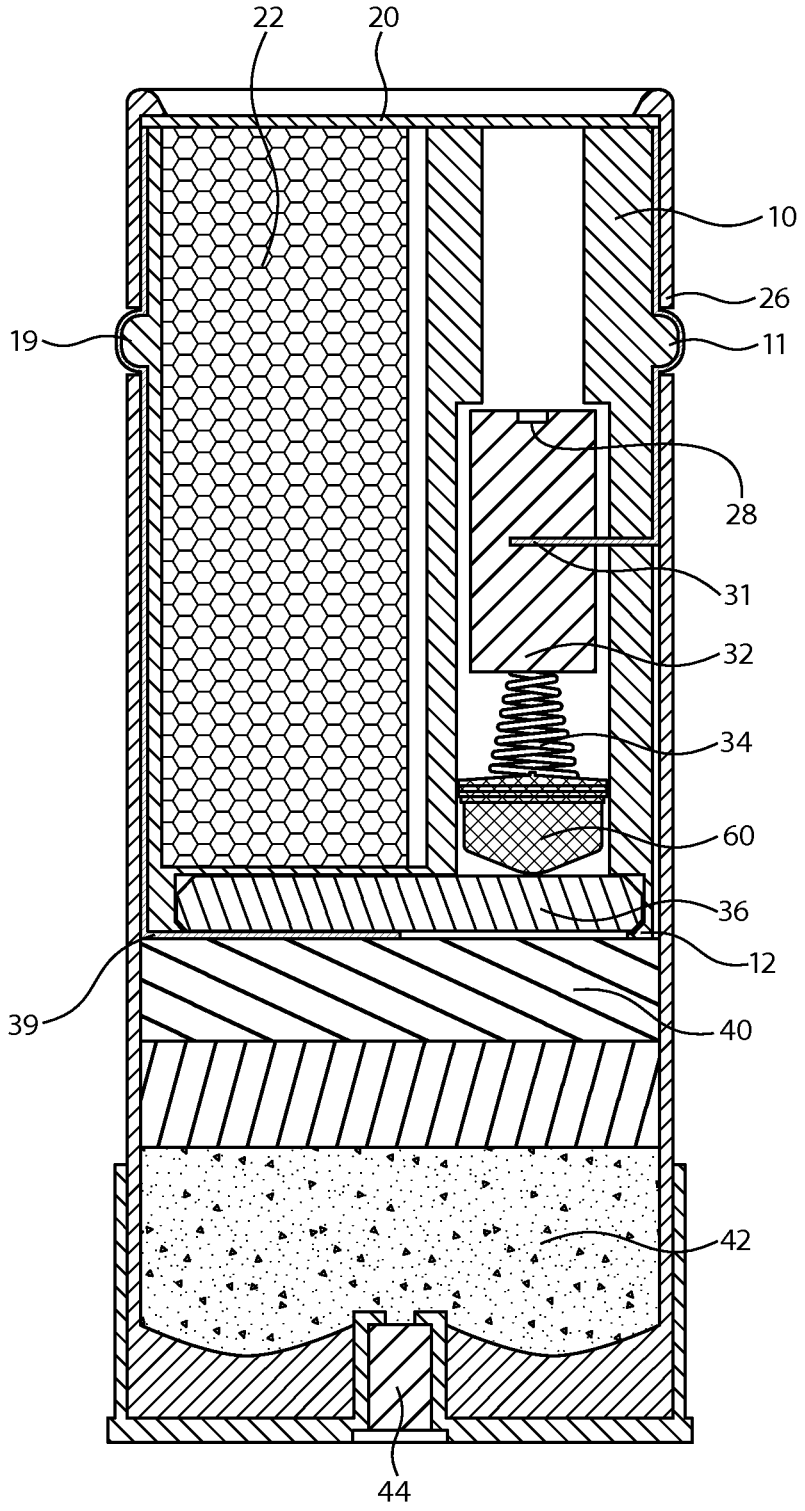
FIG. 1 is a cutaway side view of a tilt activated, laser aimed shotgun cartridge constructed according to one embodiment of the invention disclosed herein.

| Drawings - Reference Numerals | |
|---|---|
| 10 | Insert |
| 11 | Laser Module Contact Strip Lug |
| 12 | Flanged Rim |
| 13 | Throat |
| 14 | Shot Chamber |
| 15 | Floor |
| 16 | Power Supply Chamber |
| 17 | Tubular Member |
| 18 | Laser Module Chamber |
| 19 | Battery Contact Strip Lug |
| 20 | Overshot Card |
| 22 | Shot |
| 26 | Hull |
| 27 | Hole |
| 28 | Lens |
| 31 | Negative Laser Module Contact Strip |
| 32 | Laser Module |
| 34 | Spring |
| 36 | Battery |
| 39 | Positive Battery Contact Strip |
| 40 | Wad |
| 42 | Powder |
| 44 | Primer |
| 46 | Chamber Wall |
| 48 | Firing Pin |
| 50 | Magazine Wall |
| 52 | Brass Cartridge Case |
| 54 | Metallic Bullet Core |
| 60 | Positional Switch |
| 65 | Alternative Positional Switch |
| 66 | Upper Conductive Cone |
| 67 | Lower Conductive Cone |
| 68 | Nonconductive Washer |
| 69 | Conductive Ball |

DETAILED DESCRIPTION

First Embodiment

FIGS. 1, 2, 3A, 3B, 3C, 3D, 4A, 4B, 4C, and 5

Figure 2:
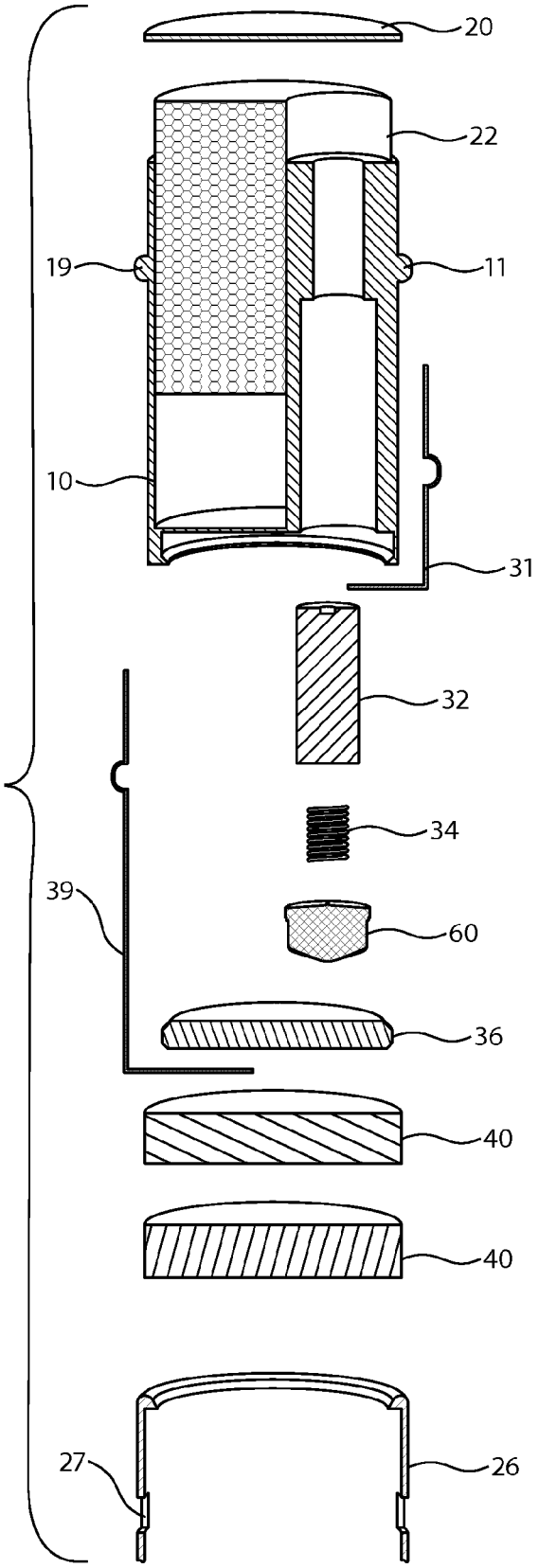
FIG. 2 is an exploded view of the individual components of the shotgun cartridge of FIG. 1.
Figure 3A:
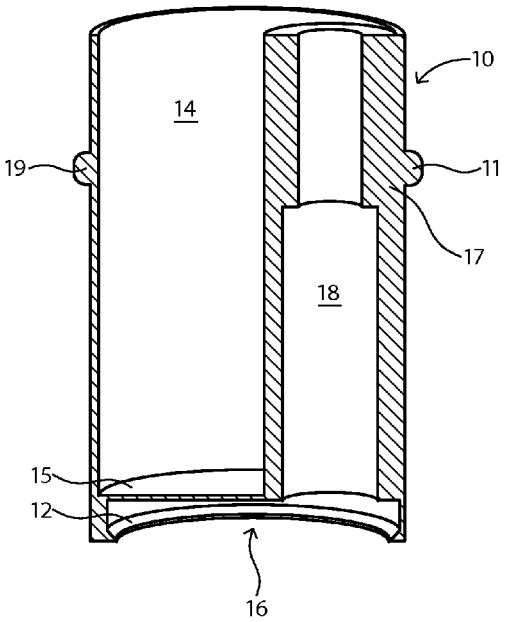
FIG. 3A, FIG. 3B, FIG. 3C, and FIG. 3D are several views of the insert used in the shotgun cartridge of FIG. 1, including cross section (FIG. 3A), oblique (FIG. 3B), bottom (FIG. 3C) and top (FIG. 3D) views.
Figure 3B:
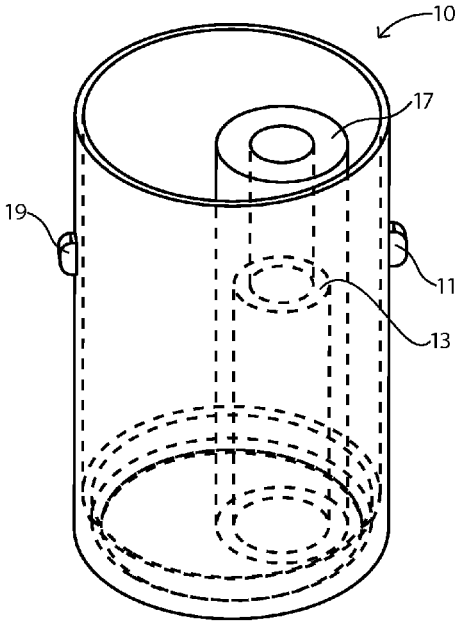
Figure 3C:
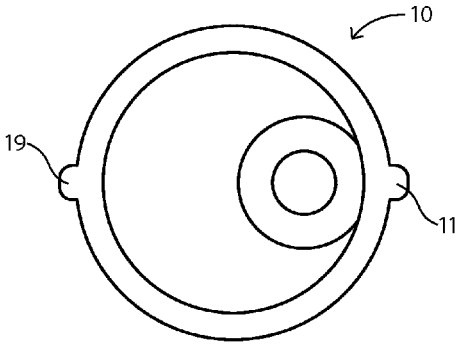
Figure 3D:
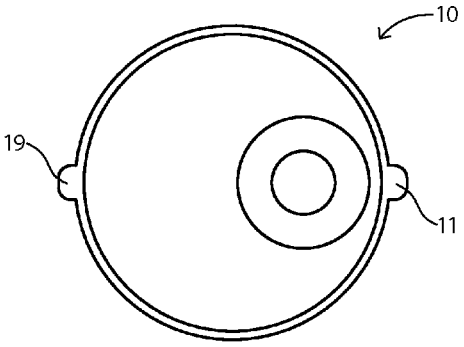

Referring now to FIGS. 1-2, there is illustrated one embodiment of tilt-activated laser aimed ammunition for a firearm as used in a shotgun cartridge. The cartridge includes a primed hull (26) containing powder (42), one or more wads (40), and an insert (10). Contained within said insert (10) is a battery (36), a positional switch (60), a spring (34), a laser module (32), and shot (22). At the mouth of the cartridge is an overshot card (20) that is held in place by a roll crimp in the hull (26). The cartridge further includes two electrically conductive contact strips, including a positive battery contact strip (39), and a negative laser module contact strip (31).

Referring now to FIGS. 3A-D, there is illustrated several views of the insert (10) used in the shotgun cartridge of FIGS. 1-2. Said insert is generally cylindrical in shape, sized to fit snugly inside the hull (26), and open at both ends. The bottom end of the insert (10) is configured with a flanged rim (12). The exterior surface of the insert (10) is configured with two lugs (39), (31) which extend from the exterior surface of the insert (10) through holes (27) in the hull (26) of the assembled cartridge shown in FIGS. 1-2.

Referring again to FIGS. 3A-D, the interior of the insert (10) includes a shot chamber (14), a power supply chamber (16), and a laser module chamber (18). The shot chamber (14) and power supply chamber (16) are partitioned by a floor (15). The laser module chamber (18) is defined by a counterbore in the lower end of a rigid tubular member (17) that extends upwardly from the floor (15) and separates said laser module chamber (18) from the shot chamber (14). In some embodiments, the counterbore may be a countersink. The tubular member (17) holds the laser module (32) parallel to the walls of the insert and the hull (26) and so parallel to the chamber and bore of the firearm such that the laser aims down the firearm bore when activated. The tubular member (17) is positioned away from the center of the floor (15) such that one side of the tubular member (17) is in contact with an external wall of the insert (10). Placement of the tubular member (17) against one wall of the insert (10) maximizes space available in the shot chamber (14) for larger types of shot (22), such as buckshot. Placement of the tubular member (17) and the internal laser module chamber (18) against the wall of the insert (10) also provides greater stabilizing support for the laser module (32) so that the laser module (32) is not easily pushed off center, for example, during assembly of a shotgun cartridge or cycling of a cartridge from the magazine into the chamber of the firearm. This not only makes the laser more accurate and reliable, but also simplifies installation of the contact strips in the cartridge.

The insert (10) holds the positional switch (60) in direct contact with the negative pole of the battery (36), and holds the positional switch (60) and laser module (32) in such a relationship that they are in direct contact only through the spring (34). In this way, the insert (10) holds the electrical components of the circuit electrically insulated from the metallic shot (22) in the shot chamber (14), thereby preventing a short circuit. In the same way, the insert (10) holds the electrical components of the circuit in such a way that the circuit is ultimately controlled by the positional switch (60) (i.e., whether the positional switch is open or closed), even after the cartridge is inserted into the chamber of a firearm.

The insert (10) may be formed from any plastic or polymer material or combination of plastic or polymer materials that is firm enough to hold the battery (36), positional switch (60), and laser module (32) in place. The material from which the insert (10) is formed can be rigid or soft enough for the laser module contact strip (31) to be pressed through the exterior wall of the insert (10) into the laser module chamber (18) to contact the laser module (32). In one embodiment, the insert may comprise a preformed slot or hole through which the laser module contact strip (31) may be inserted to contact the laser module (32) during assembly of the cartridge. In some embodiments, the insert (10) is made from one or more of polyester, polyethylene terephthalate, polyethylene, high-density polyethylene, low-density polyethylene, polyvinyl chloride, polypropylene, high-impact polystyrene, polyamides (nylons), acrylonitrile butadiene styrene, and polycarbonate. Other suitable plastics and polymer materials will be known to the skilled artisan. In one embodiment, the insert (10) is injection molded of high-density polyethylene. In another embodiment, the insert (10) is made with 3D printing.

The laser module (32), spring (34), positional switch (60) and battery (36) fit sequentially into the insert (10) from the bottom. The laser module (32) is prevented from slipping too far forward in the insert (24) by a throat (13) inside the tubular member (17) of said insert (10) as illustrated by the oblique view in FIG. 3B. The laser module (32), spring (34), positional switch (60) and battery (36) are prevented from falling out of the bottom end of the insert (10) by the flanged rim (12). The flanged rim (12) constricts the opening into the power supply chamber (16) at the bottom of the insert (10) so that the battery (36) may be snapped into place in the power supply chamber (16) upon the application of light pressure, such as hand pressure. In this way, the laser module (32), spring (34), and positional switch (60) are sandwiched between the throat (13) of the insert (10) and the battery (36), which is retained in the power supply chamber (16) by the flanged rim (12) at the bottom of the insert (10).

The overshot card (20) is circular and sized to fit snugly inside the mouth of the hull (26). Said card (20) is pressed against the upper face of the insert (10) to retain shot (22) within the shot chamber (14) of the insert (10). The overshot card (20) is formed from a stiff but flexible transparent material, such as a clear acrylic or other plastic or polymer material, to allow the passage of electromagnetic radiation from the laser module (32) through said card. In some embodiments, the overshot card (20) is formed from a rigid transparent material. The overshot card (20) shatters when contacted by shot (22) expelled from the cartridge upon discharge of the firearm.

Unlike existing devices, the present invention uses an overshot card (20) that contains no holes, perforations or other openings. This prevents the sort of extraneous matter to which shotgun cartridges are frequently exposed, such as pocket lint, gunpowder, dust, oils, and other debris, from entering the laser module chamber (18) and rendering the laser module (32) useless by obstructing the laser lens (28) and disrupting or blocking the passage of laser light. This feature of the present embodiment also simplifies maintenance and cleaning of the cartridge. Whereas removal of debris from the laser module lens (28) would require disassembly of the cartridge, which is inconvenient, unsafe, and renders the cartridge unusable, the use in the present embodiment of a thin, stiff overshot card (20) having a smooth surface overcomes this deficiency by preventing debris from entering the laser module chamber (18). This feature also maximizes the amount of laser light passed through the card, and facilitates quick, easy and one-handed removal of any smudges or debris that may accumulate on the overshot card (20). However, in alternate embodiments, the overshot card (20) may be formed of a translucent or opaque material. In such embodiments, the overshot card further comprises an off-center hole configured to be positioned directly over the laser module chamber (18) so that laser light may pass therethrough.

Laser module (32) is an off the shelf item of various external dimensions, light frequencies, power requirements and outputs. Some outputs project shaped visible laser lights such as crosses, circles, or various sized dots. Some lasers output infrared light visible only with optical equipment such as night vision devices. Other laser modules output light in a steady beam or intermittent bursts. Laser modules are available pre-focused with lens (28) built in and the projected design or pattern pre-programmed.

Spring (34) is attached to the base of laser module (32) and contacts a portion of the positional switch (60) that conducts electrical current to the spring (34) only when the positional switch is in a closed position. When the positional switch (60) is closed, said spring (34) conducts electrical current from the positional switch (60) to the laser module (32) circuitry. The spring (34) also applies spring pressure to the laser module (32) to urge said module against the throat (13) of the laser module chamber (18). It may be insulated or not depending on the specific application. No insulation is needed for the embodiment depicted in FIGS. 1 and 2. However, in the metallic cartridges illustrated in FIGS. 6 and 7, some form of insulation would be necessary to prevent shorting with the material within the projectile.

Positional switch (60) is an off the shelf, normally open, electromechanical, omnidirectional tilt switch in electrically conductive contact with the negative pole of the battery (36) and the spring (34). However, as explained below, said positional switch (60) only conducts electrical current to the spring (34) and then to the laser module (32) when the normally open switch is in a closed position. The positional switch (60) may be of various external dimensions, switching times, working angles (also known as "activation" or "tilt" angle), resistance, current and voltage capabilities, operating temperature, and lead type. In some embodiments, the positional switch (60) has an activation angle of from approximately 10 to approximately 80 degrees from vertical. In certain embodiments, the activation angle is from approximately 20 to approximately 70 degrees from vertical. In certain embodiments, the activation angle is from about 30 to about 60 degrees from vertical. In one embodiment, the activation angle is approximately 30, 31, 32, 33, 34, 35, 36, 37, 38, 39, 40, 41, 42, 43, 44, 45, 46, 47, 48, 49, 50, 52, 53, 54, 55, 56, 57, 58, 59, or 60 degrees from vertical.

Positional switches are used to automatically control an external electric circuit based on the motion of an internal actuator contained within the switch itself. At various points in its travel, the actuator opens or closes one or more sets of electrical contacts in the switch to cause an electrical signal to operate a device in circuit with the switch. A tilt switch is a positional switch that is sensitive to angular change. A normally open tilt switch is one in which the contacts are open and the switch non-conducting while the actuator is in a rest position. The contacts become closed and the switch conducting when the switch is tilted beyond a certain working angle so that the actuator touches the appropriate contacts. Omnidirectional tilt switches are those wherein the contacts become closed when the switch is tilted beyond a certain angle from vertical in any direction. Some positional switches employ one or more conductive metal balls as an actuator, while others rely on a conductive metal rod. Still others employ a small amount of liquid mercury as an actuator. Although mercury-based positional switches are functional in a cartridge of the present embodiment, the toxicity of mercury makes such switches unsuitable for use in small arms ammunition. Therefore, switches most suitable for use in the present embodiment are non-mercury contact switches.

Figure 4A:
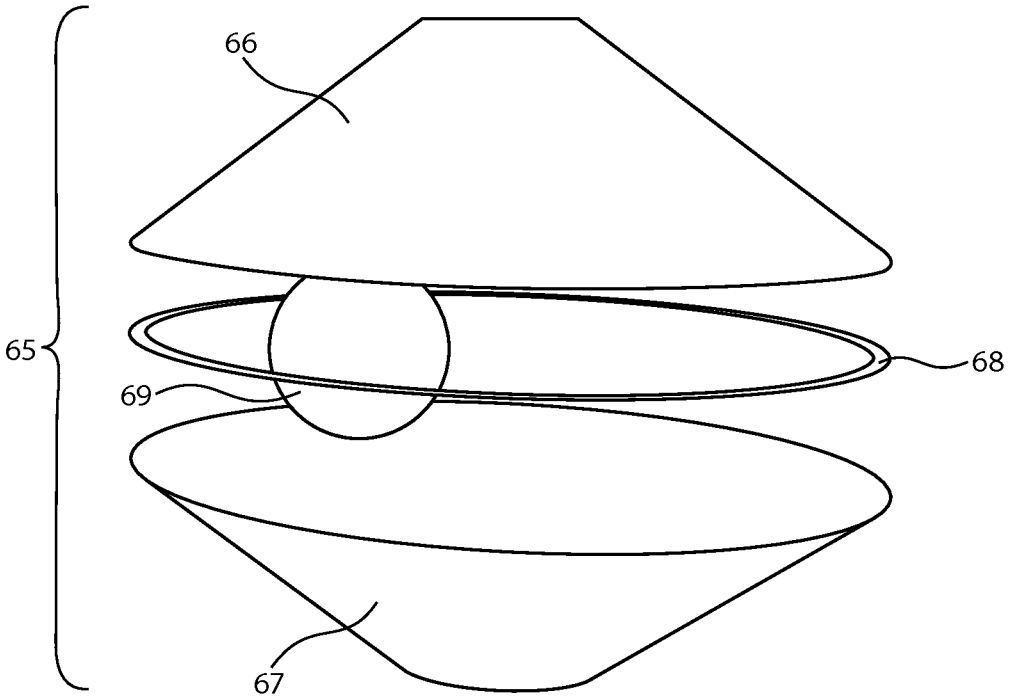
FIG. 4A, FIG. 4B, and FIG. 4C are several views of an alternative positional switch suitable for use in the shotgun cartridge of FIG. 1, including an exploded view (FIG. 4A), a cross sectional view showing switch in a closed position (FIG. 4B) and a cross sectional view showing switch in an open position (FIG. 4C).
Figure 4B:
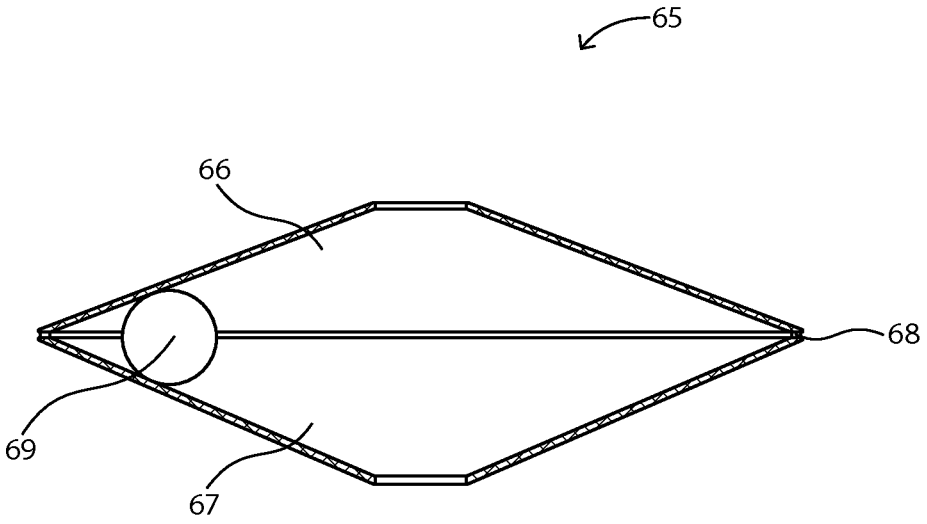
Figure 4C:
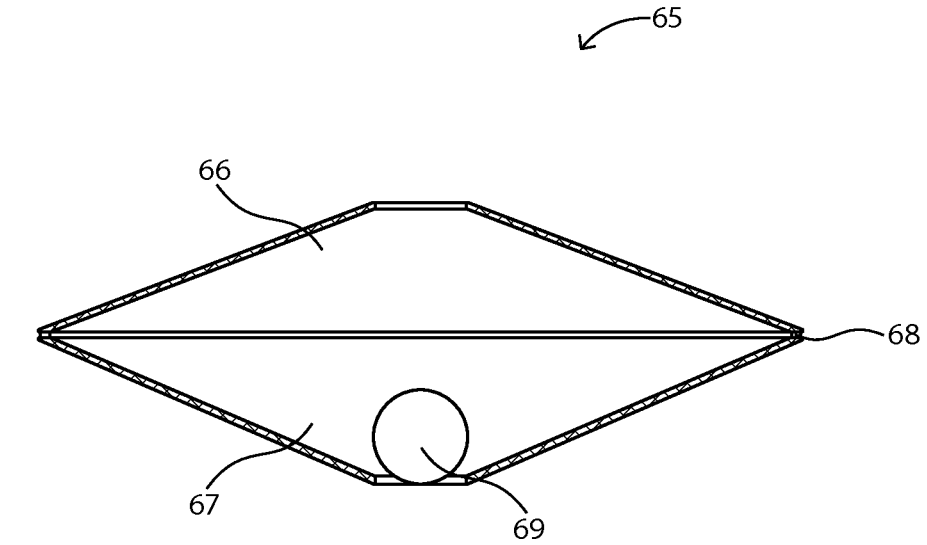
Figure 5:
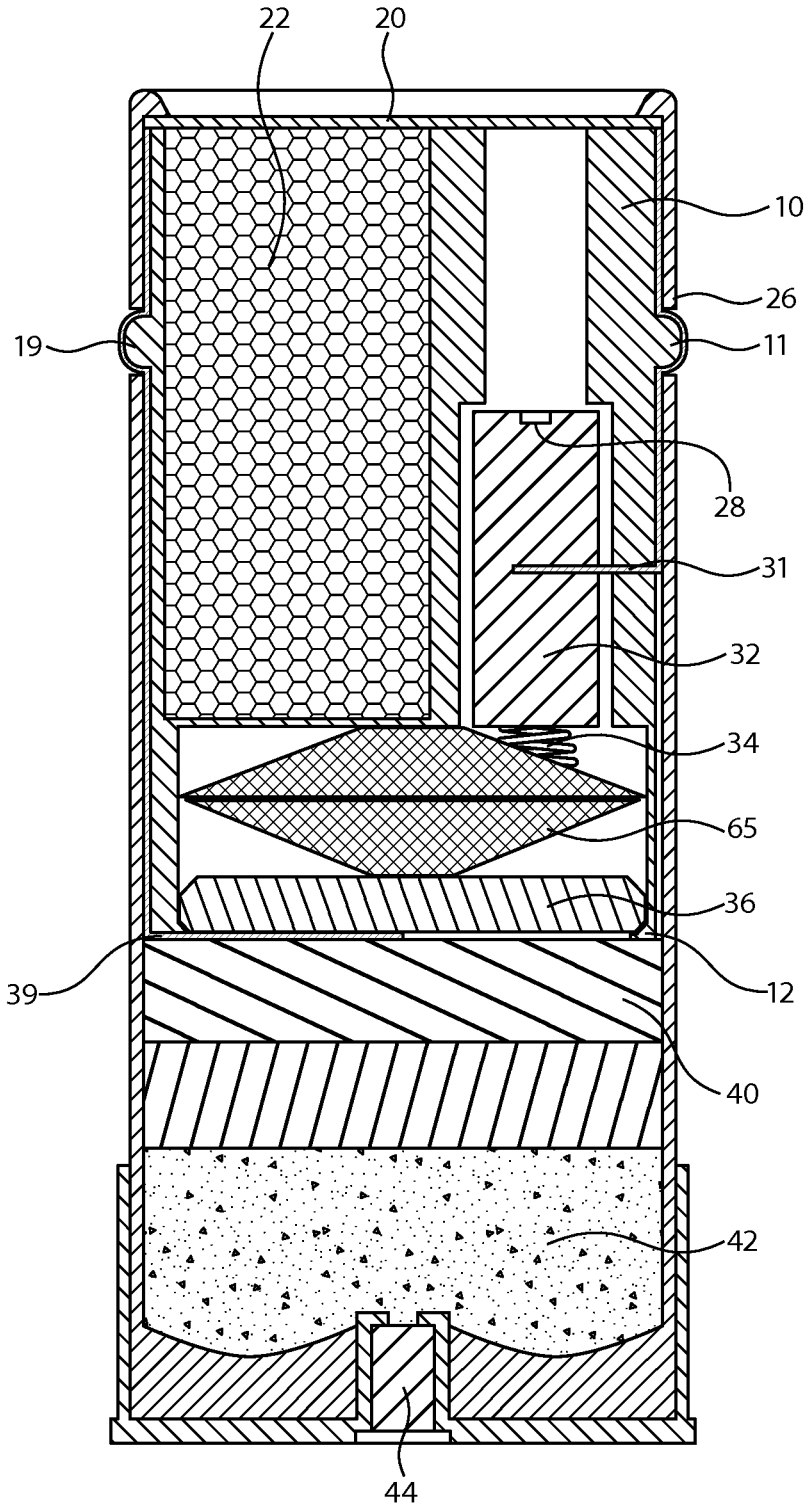
FIG. 5 is a cutaway side view of another embodiment of the shotgun cartridge of FIG. 1 using the positional switch of FIG. 4.

FIGS. 4A-C show several views of an alternative non-mercury, normally open, electromechanical, omnidirectional tilt switch (65) suitable for use with the invention disclosed herein, as illustrated by the embodiment depicted in FIG. 5. The switch (65) comprises upper and lower conductive cones (66), (67) which function as contacts. The cones are separated by a nonconductive washer (68), which may be a nylon washer. Inside the switch (65) is an actuator in the form of a conductive metallic ball (69). The switch is open when the ball (69) is touching only one of conductive cones (66) or (67) as shown in FIG. 4C. The switch is closed when tilted to its activation angle such that the ball (69) contacts both conductive cones (66) and (67) as shown in FIG. 4B.

Battery (36) is an off the shelf item, but is preferably a button or coin battery having a long shelf life. In one embodiment, the battery is a CR1616 lithium battery.

Electrical contact between the laser module (32) and the chamber wall (46), and later between the chamber wall (46) and battery (36) is provided by metallic positive and negative battery and laser module contact tape or strips (39), (31), respectively. These contact strips (39), (31) are made of a thin, electrically conducting material that can fold down the outside of the insert (10). In the present embodiment, these strips need not be insulated. There is no risk of excessive buildup of pressure in the chamber when the cartridge is fired and thus no need to mitigate said pressure by configuring said strips (39), (31) with breakaway notches or similar relief cuts because the strips (39), (31) do not overlap the exterior of the hull (26) when assembled into a cartridge of the present embodiment, as best shown in FIGS. 9 and 11. This greatly reduces the complexity and cost of manufacturing cartridges.

The shot (22) may be any size or gauge of shot commonly used in shotgun cartridges, including small metallic "birdshot" and large caliber "buckshot" depending on the intended use of the cartridge. Shot may also be comprised of a bag or other package containing lightweight, non-lethal material designed to stun an adversary. Exemplar non-lethal materials include bean bags, tear gas, and rubber bullets. Shot (22) is contained in the shot chamber (14) of the insert (10).

The balance of the items drawn and listed are industry standard. Magazine wall (50) and firing pin (48) are standard firearm parts. Cartridge parts include cases (52), metal cores (54), primer (44), powder (42), and wads (40).

Figure 10:
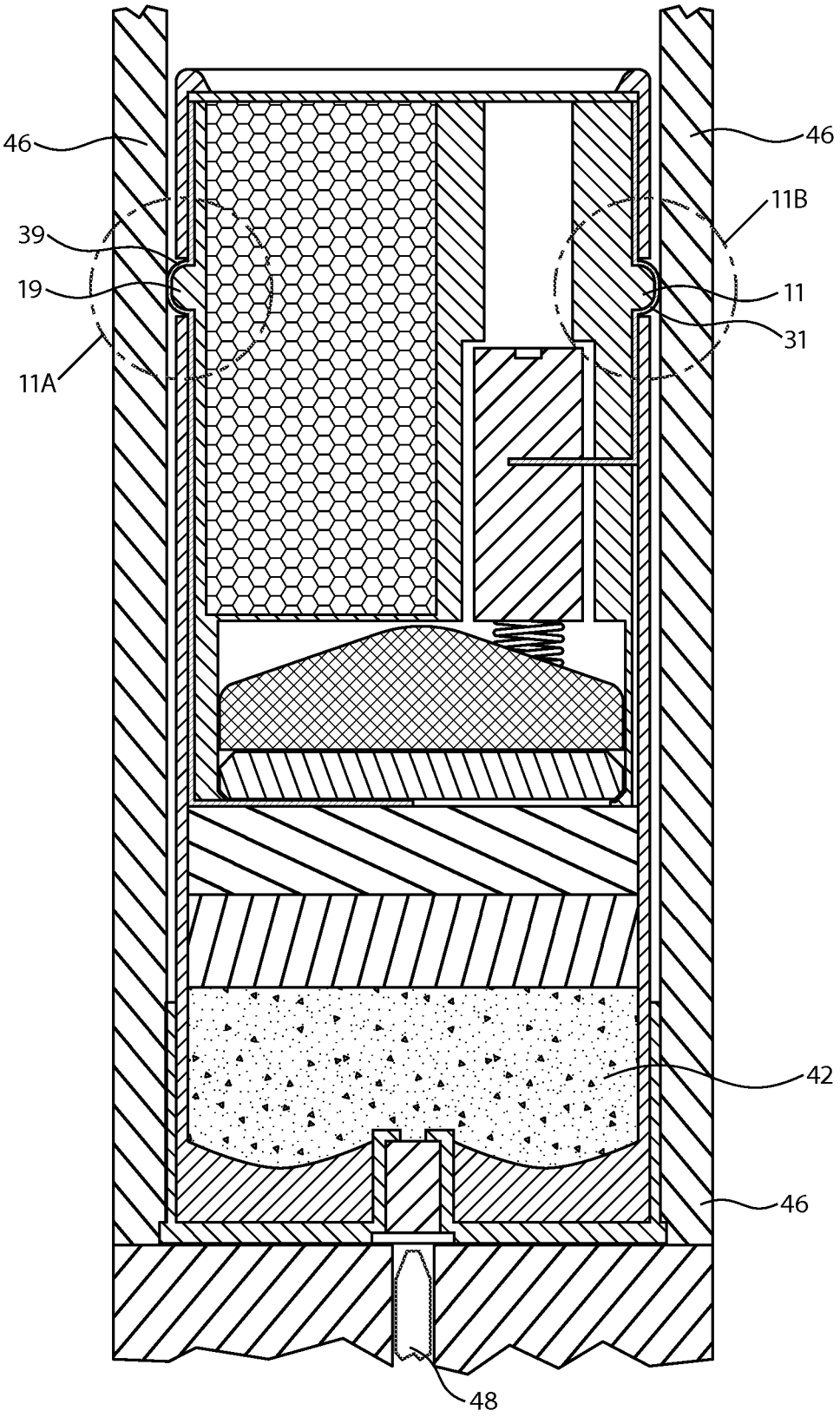
FIG. 10 shows a cutaway side view of the shotgun cartridge of FIG. 1 in the chamber of a firearm.

Assembly of the shotgun cartridge of the present embodiment requires sequential placement of the laser module (32), spring (34), positional switch (60), and battery (36) into the insert (10) as described above. Strips (39) and (31) are installed into the insert (10) before the insert (10) is placed into the hull (26). Contact strips (39) and (31) are adhered to the exterior of the insert (10), and are supported at their upper ends by lugs (19) and (11), respectively. The lugs (19), (11) support the contact strips (39), (31) through two holes (27) cut in the hull (26) and against the chamber wall (46) as shown in FIG. 10-11. The positive and negative contact strips (39) and (31), respectively supported on lugs (19) and (11), protrude through holes (27) in hull (26) when fully assembled into a finished cartridge of the present embodiment.

The lower end of negative laser module contact strip (31) extends through an appropriately small slot or hole in the exterior wall of the insert (10) and the tubular member (17) to contact the brass exterior of the laser module (32). The lower end of positive battery contact strip (39) folds underneath the bottom of the insert (10) to make electrical contact with the bottom of battery (36). The positive battery contact strip (38) is adhered to the bottom of battery (36). When combined into the insert (10) as described herein, the laser module (32), spring (34), positional switch (60), battery (36), contact strips (39), (31) form a self-contained, drop-in laser sighting assembly which can be used in any commercially available shotgun shells and is suitable for use in home shotgun shell reloading. The wads (40), laser sighting assembly, shot (22), and overshot card (20) then fit sequentially into a primed hull (26) over an appropriate powder charge. The cartridge is then sealed and ready for use.

The generally cylindrical shape and multi-chamber design of the insert (10) and completed laser sighting assembly simplifies and lowers the cost of manufacturing a cartridge of the present embodiment as compared to prior art cartridges by eliminating steps and compartmentalizing major component groups. Specifically, the configuration of contact strips (39), (31) and lugs (19),(11) on the insert (10) eliminates any need to first fit the insert into a hull (26) before piercing the hull with electrically conductive pins as taught in U.S. Pat. No. 8,544,203. The use of contact strips instead of pins also helps the electrical circuit in the laser aimed cartridges disclosed herein function more reliably than cartridges configured with pins. Additionally, the fact that the laser module (32), spring (34), positional switch (60), battery (36), and contact strips (39), (31) can be installed into the insert (10) independently of the remaining components of the completed cartridge, including the hull (26), powder (42), wad (40), shot (22), and overshot card (20) (collectively, "shell components"), to form a self-contained, drop-in laser sighting assembly allows for the separate manufacture of the laser sighting assembly component at a different location from where the shell components are manufactured or where the cartridge will be finally assembled. This advantage minimizes any special tooling needed to manufacture commercial quantities of the cartridges disclosed herein. It also makes the laser sighting assembly ideal for use with commercially available consumer reloading products, and provides a solution for shooters who prefer to load their own ammunition, as the only modification which must necessarily be made to the hull (26) is the creation of holes (27) through which the lugs (19), (11) and contact strips (39), (31) may pass.

Alternative Embodiments

Figure 6:
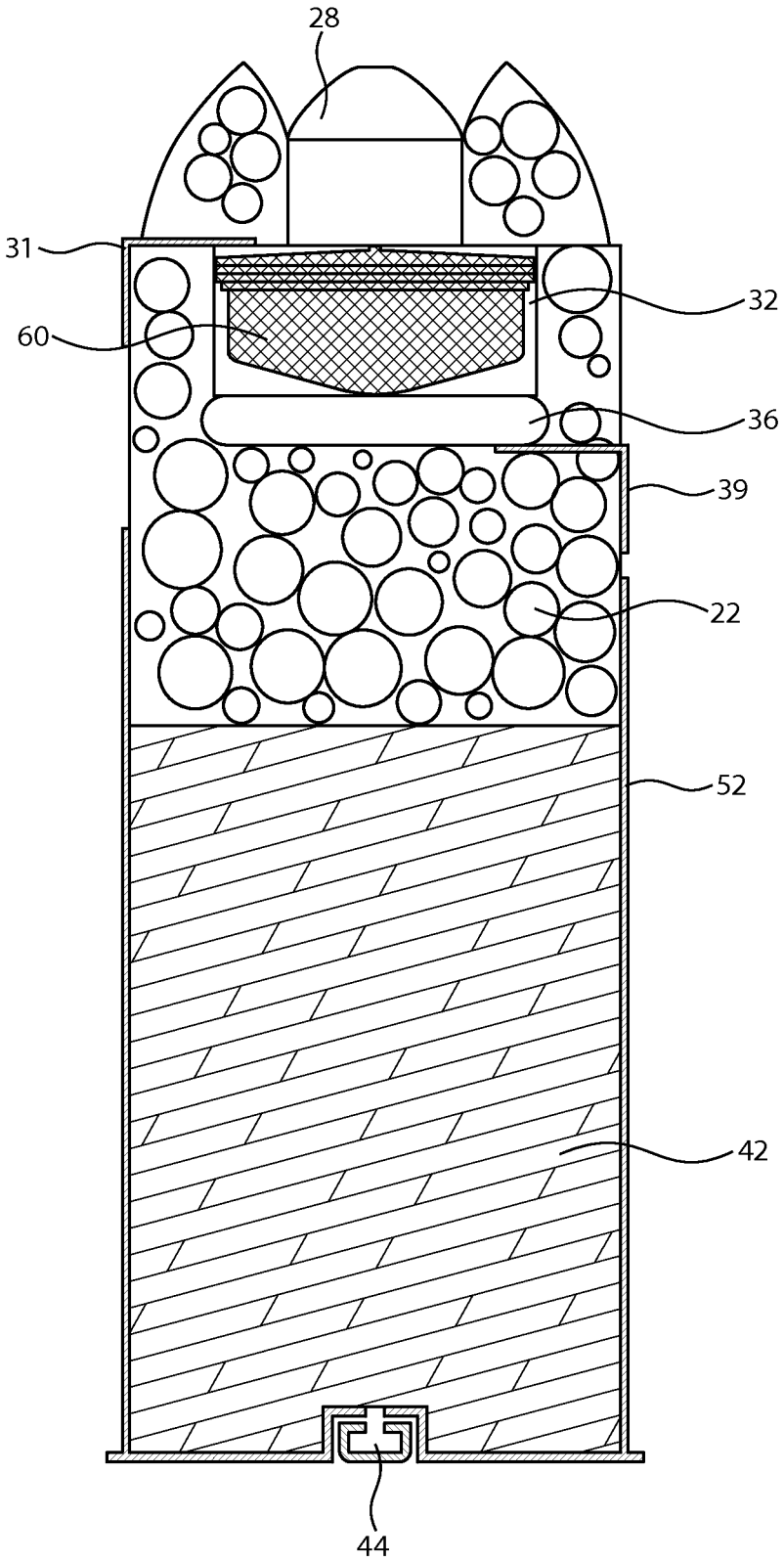
FIG. 6 shows another embodiment of the invention disclosed herein used in a metallic cartridge with a load of shot.
Figure 7:
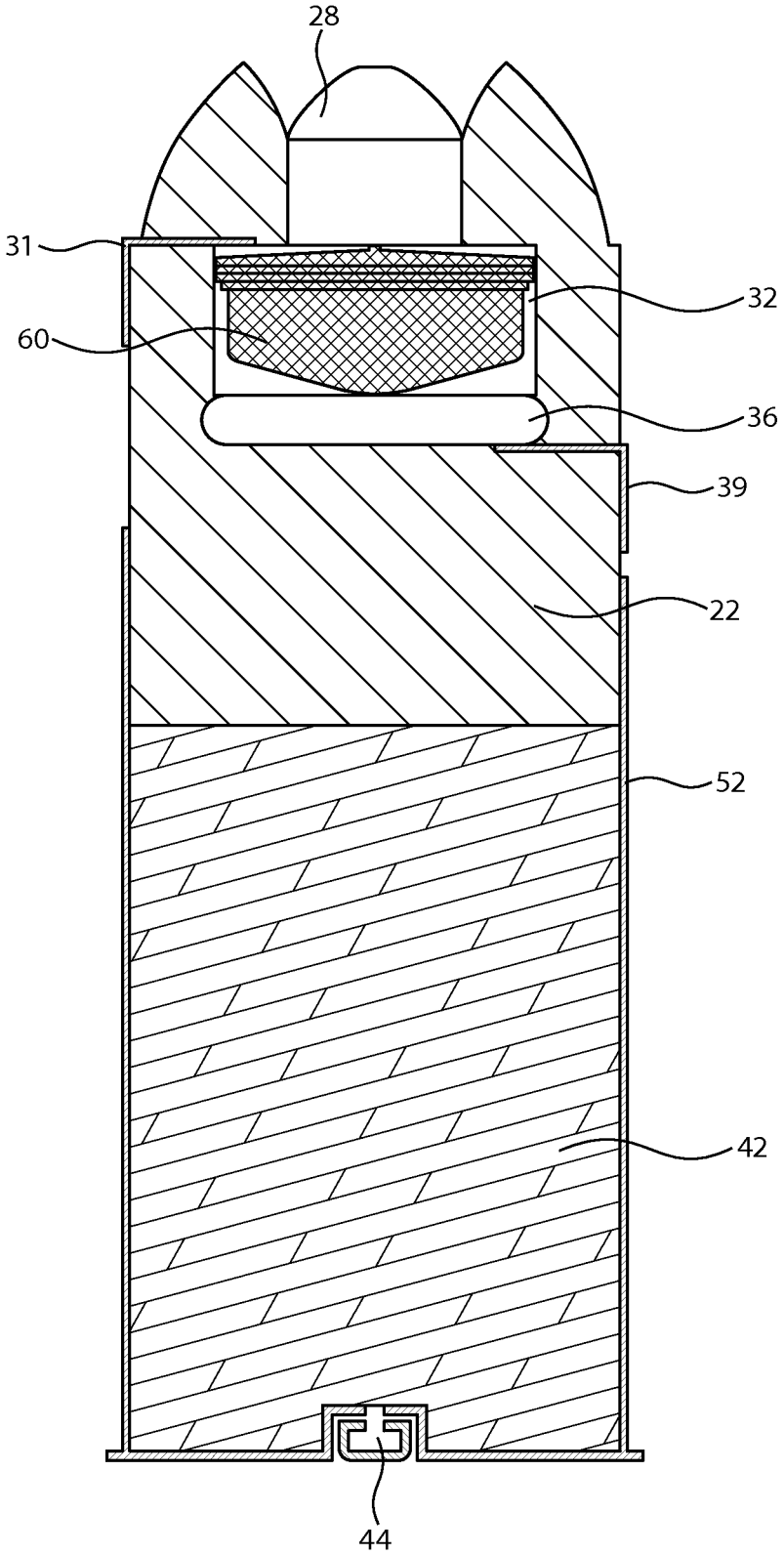
FIG. 7 shows still yet another embodiment of the invention disclosed herein used in a metallic cartridge with a lead core.

FIGS. 6 and 7

FIG. 6 shows an embodiment of the present invention in a metallic shot cartridge for use in a handgun or rifle. The laser module (32), spring (34), positional switch (60), battery (36) and contact strips (39), (31) are electrically insulated from the shot (22) and brass jacket (52) of the bullet. This is accomplished by coating said module (32), spring (34) and battery (36) with an insulating plastic such as high density polyethylene similar to the insert in the first embodiment above. Alternatively, an insert of a suitable shape would be used to insulate the electrical components from the core pellets. The contact strips (39) and (31) are insulated metallic tape. The insulation is removed from the face of the tape on the outside of the bullet's jacket. The exposed face of the tape would make electrical contact with the chamber of the firearm. The circuit would be completed when the firearm in which the cartridge is chambered is held within the working angle of the positional switch (60). When the circuit is complete the laser module is activated and projects a beam of visible light through lens (28) and axially through the bore of the firearm. The insulation and adhesive under the tape insulates it from the electrically conducting metallic jacket of the bullet. The cartridge need not be removed from the chamber to save battery life should the cartridge not be fired. Instead, the firearm need only be placed within a certain angle to vertical that is outside of the working angle of the positional switch. FIG. 7 repeats the description from FIG. 6, but embodied in a solid core (54) bullet.

Use and Operation—FIGS. 8, 9A, 9B, 10, 11A, 11B, 12A, and 12B In use, a cartridge will ultimately be placed in the chamber of a firearm, whether the firearm is a breach loading firearm or a magazine fed firearm. However, because many firearms used today are magazine fed, it is important that the laser module remain off while the cartridge is present in a magazine. Accordingly, the tilt activated laser aimed ammunition of the present invention is designed to remain off while present in the magazine of a firearm.

Figure 8:
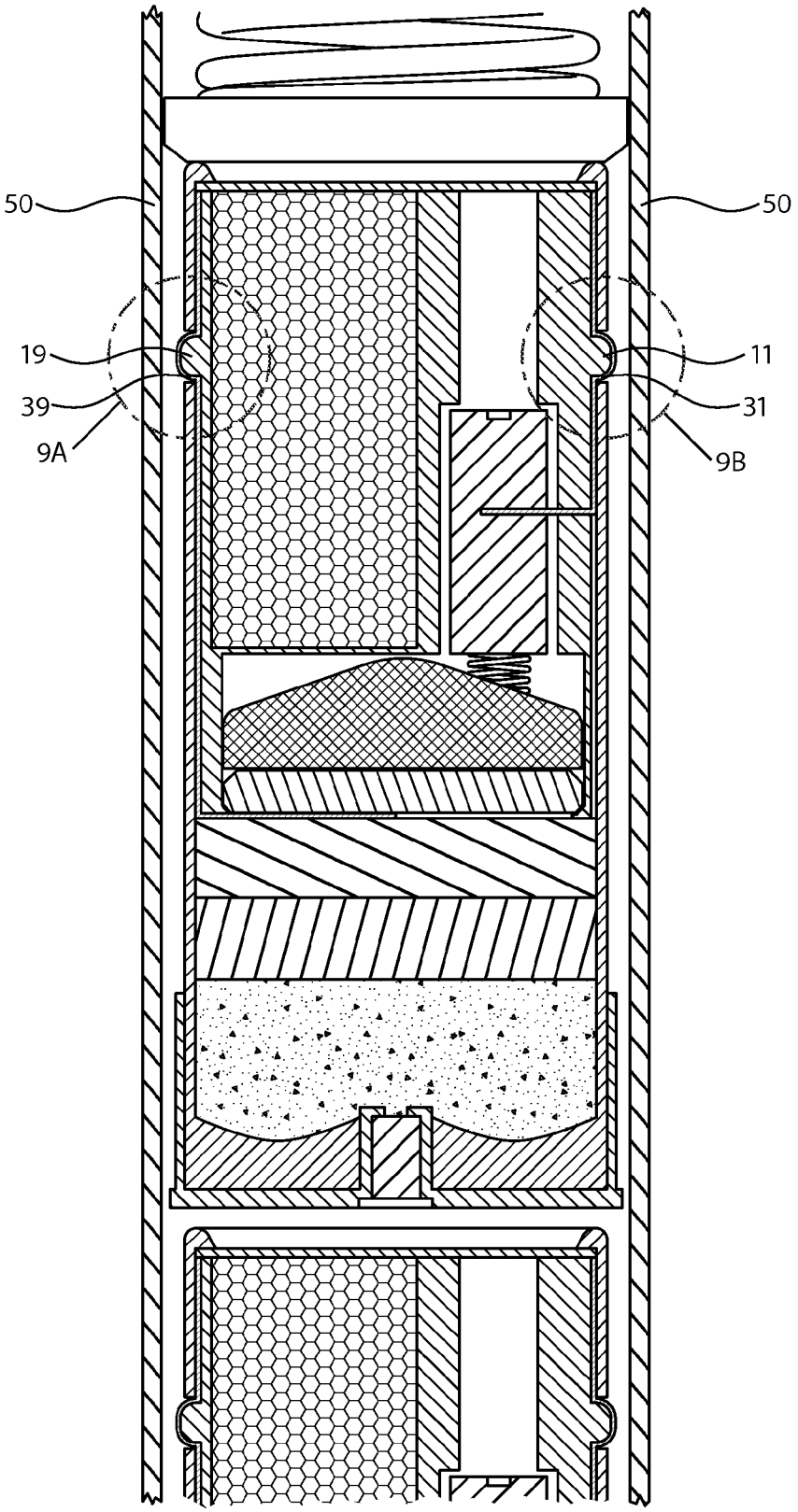
FIG. 8 shows a cutaway side view of the shotgun cartridge of FIG. 1 in the magazine of a firearm.

Referring now to FIG. 8, there is shown the cartridge of FIG. 1 in the magazine of a firearm capable of firing shotgun cartridges. Since tolerances within such magazines are designed to be significant, contact strips (39) and (31) do not contact the electrical conducting metallic walls of the magazine (50) at the same time, and thus do not complete a circuit capable of activating the laser (32) while said cartridge is in the magazine, regardless of whether the firearm is held within the working angle of the positional switch (60).

Figure 9A:
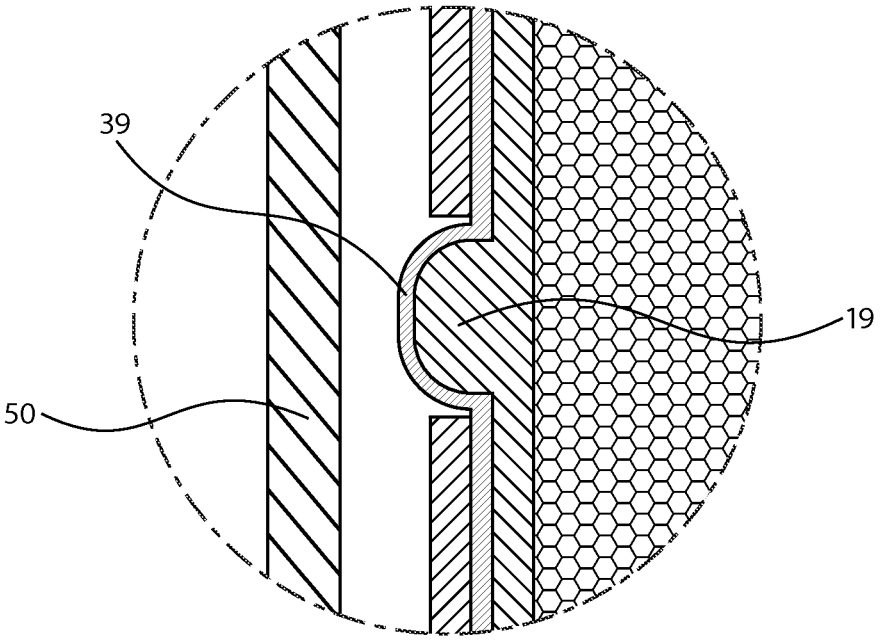
FIG. 9A and FIG. 9B are enlarged views of the insets of FIG. 8 showing how the electrically conductive contact strips do not contact magazine walls.
Figure 9B:
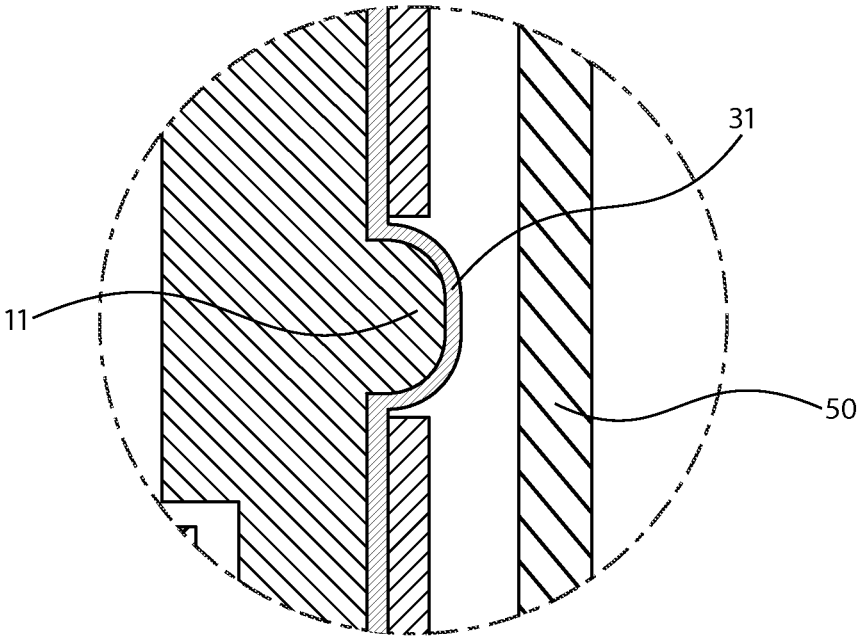

FIG. 9A and FIG. 9B show enlarged views of the insets of FIG. 8 illustrating the lack of contact between contact strips (39), (31) with the magazine walls (50). Although it is possible for one of the two contact strips to touch the magazine wall (50) at one time, contact with the wall by one contact strip alone would not create a circuit and the laser would not activate regardless of whether the firearm is held within the working angle of the positional switch (60). Even if both contact strips (39), (31) were somehow forced into contact with the metal walls of the magazine (50), for example, due to the magazine being bent or otherwise damaged, the integral positional switch (60) within the cartridge would prevent the laser from activating while the firearm is held in a position at a more acute angle to vertical than the working angle of the switch (60).

Figure 12A:
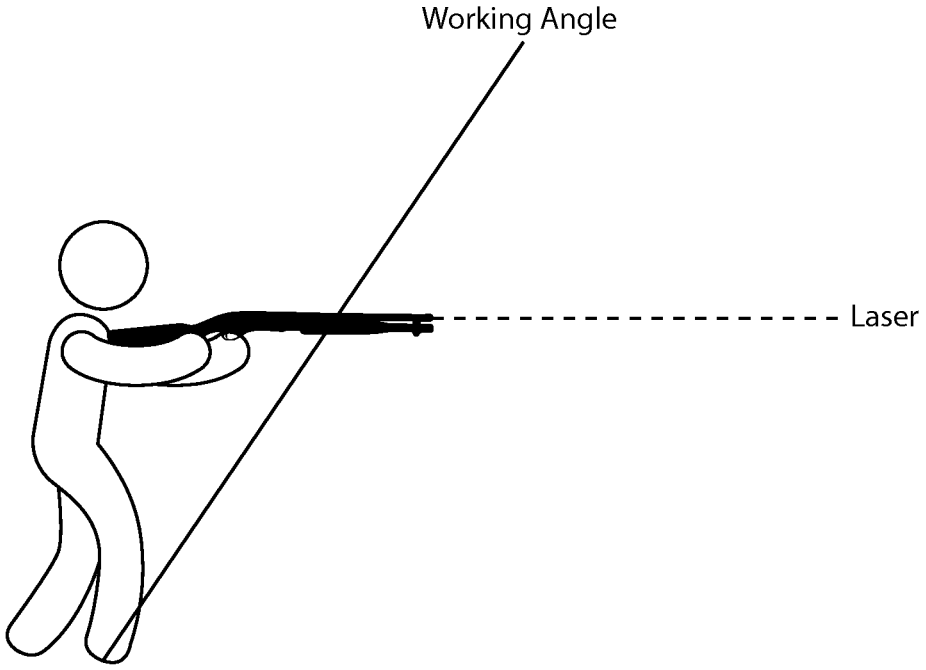
FIG. 12A and FIG. 12B show a firearm in which the cartridge of FIG. 1 is chambered being held in a position outside the working angle of the positional switch such that the laser is deactivated (FIG. 12B) and within the working angle of the positional switch such that the laser is activated (FIG. 12A)
Figure 12B:
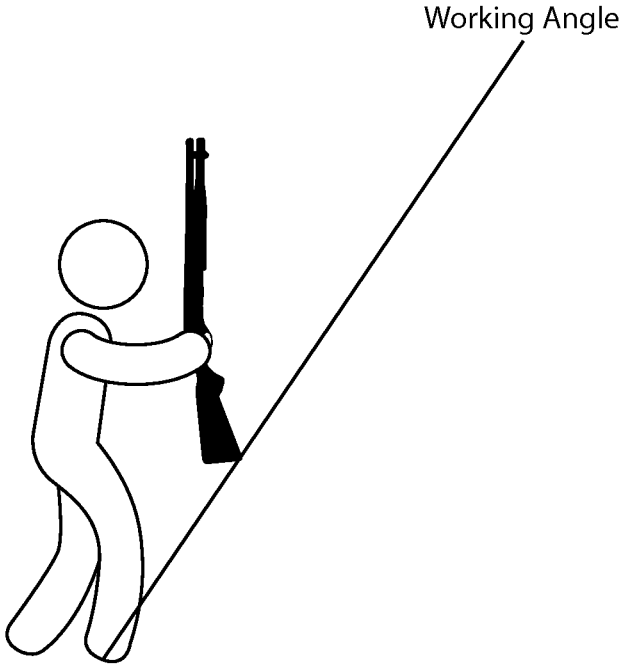

As illustrated in FIG. 10, when placed in the chamber of a firearm, the contact strips (39), (31) of the cartridge make electrical conducting contact with the metallic chamber walls (46). This is due to a combination of the tight tolerances of the chamber (46) and the lugs (19), (11) of the insert (10), which support and bias said strips (39), (31) away from the exterior of the insert (10), through the holes (27) in the hull (26), and against the chamber walls. However, even when inserted in the chamber of the firearm, the laser will remain off while the firearm is held an a more acute angle to vertical than the working or activation angle of the positional switch (60), as shown in FIG. 12B.

Figure 11A:
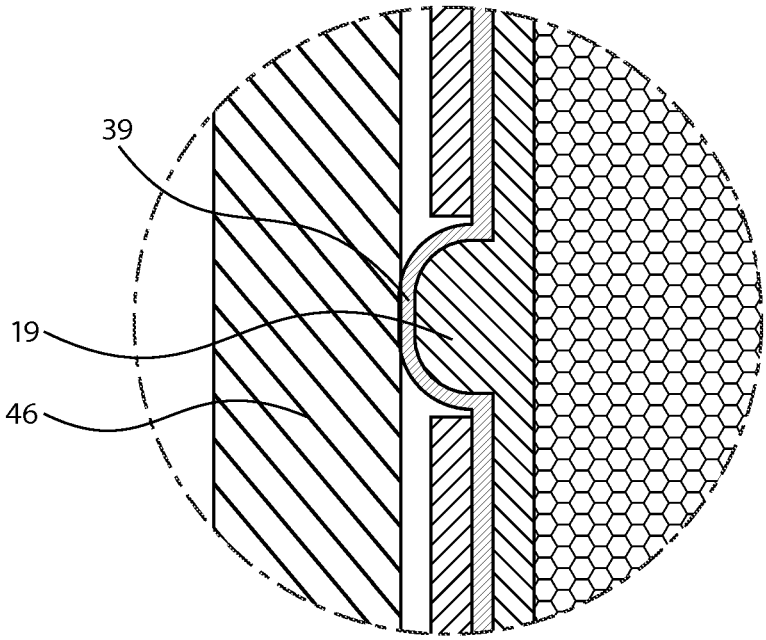
FIG. 11A and FIG. 11B are enlarged views of the insets of FIG. 10 showing how the electrically conductive contact strips contact the chamber walls.
Figure 11B:
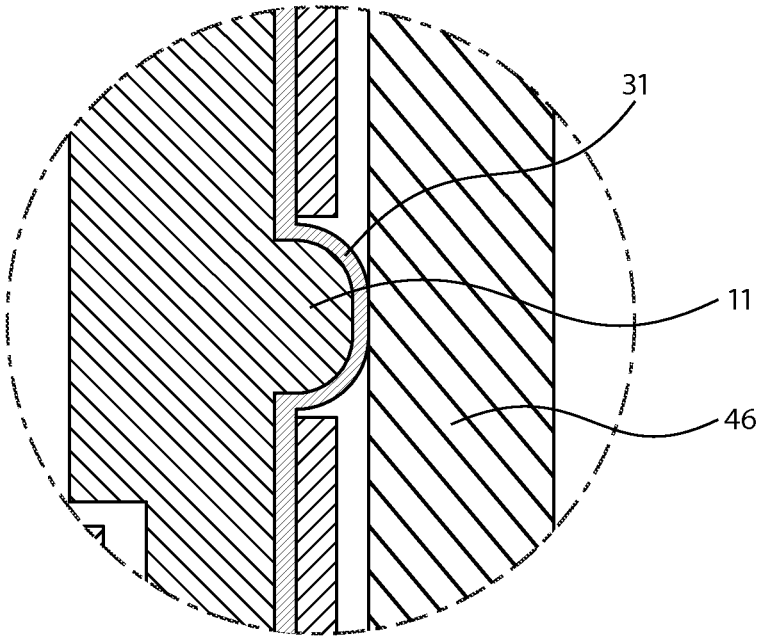

FIG. 11A and FIG. 11B show enlarged views of the insets of FIG. 10 illustrating the contact between contact strips (39), (31) with the chamber walls (46). Importantly, this does not establish a circuit unless the positional switch is also closed. The circuit is only closed when the firearm, and thus the positional switch (60) inside the cartridge loaded in the chamber of the firearm, is held at a greater angle from vertical than the working angle of the positional switch (60), as illustrated in FIG. 12A. This establishes a closed circuit from the battery (36), through the positional switch (60) and spring (34), and into the circuitry of the laser module (32), which is grounded in the case of the module (32). The negative laser module contact strip (31) connects the case of the laser module (32) to the electrically conducting chamber wall (46). The current then flows around chamber wall (46) to the positive battery contact strip (39) and back to the battery (36). When the circuit is complete, the laser module (32) is operational and sends a focused beam of laser light through the tubular member (17) of the insert (10) and the transparent overshot card (20). The light then travels axially through the barrel of the firearm to illuminate the exact spot the shot will impact, within the range of the ammunition, should the weapon be fired. The circuit is automatically broken and the laser deactivated when the muzzle of the firearm is raised to a position outside the working angle of the positional switch (60), as shown in FIG. 12B.

When the trigger of the firearm is pulled, the firing pin (48) is released to contact and crush the primer (44) of the cartridge. Crushing the primer (44) causes a primary detonation that ignites the powder (42). The rapidly expanding gasses resulting from ignition of the powder (42) will impinge on the wads (40) and force the entire payload including wads (40), battery (36), positional switch (60), spring (34), laser module (32), insert (10), shot (22), and overshot card (20) down the barrel towards the target. The contact strips (39) and (31) slide easily out of contact with the chamber walls and over the edge of the holes (27) in the hull (26) to be sent downrange with the payload, eliminating any need for relief cuts in said strips (39), (31). As ignition and propulsion are almost instantaneous, the laser illumination becomes irrelevant once the trigger is pulled.

If said cartridge is not fired, it can be stored in the chamber of the firearm with the laser deactivated and without loss of battery life while the firearm is stored in a generally upright position outside the working angle of the positional switch (60), for example, such as the position of a firearm leaning against a wall with the buttstock on the ground. The cartridge can remain in the chamber with the laser off in a roughly upright storage position for the life of the battery (approximately ten years). Alternatively, the cartridge can be removed from the chamber and stored until desired. The electrical circuit will be broken and the laser deactivate when the cartridge is removed from the chamber, regardless of the angle at which the cartridge is held. The cartridge can therefore be stored outside the chamber with the laser off in any position for the life of the battery. Should the battery lose its charge, the cartridge will continue to be useful as a normal cartridge for another thirty years or more.

The utility of self-contained, tilt-activated laser aimed ammunition for firearms is readily apparent. Cartridges embodying the present disclosure are lightweight, reliable, inexpensive to manufacture and purchase, easy to use, require no training to use beyond normal firearms safety training, and offer significantly longer shelf-lives with greater convenience than existing devices. Tilt-activated laser aimed firearms ammunition also provides a marked increase in assistance to a shooter in life-threatening and stressful situations where one may need to protect one's own life or the life of another from an aggressor. The ammunition can be safely stored in the chamber of a firearm until needed, and activated without thought or the need to manually actuate a separate switch to place a brightly illuminated dot on an aggressor using only the normal motion inherent to pointing a firearm. This saves valuable time during stressful situations, where fine motor skills can be deficit. The present invention also protects a shooter from an aggressor, particularly in poorly lit defensive scenarios such as home invasions, by allowing the shooter to silently activate an accurate laser sighting device without cycling a cartridge into the chamber from a magazine and thereby revealing the shooter's position or the fact that the shooter is armed. This gives the shooter the considerable advantages of markedly increased stealth, better response time and faster target acquisition, all of which combine to provide the shooter the element of surprise.

While the above descriptions contain much specificity, these should not be construed as limitations on the scope of the invention, but rather as an exemplification of one or more preferred embodiments thereof. Many other variations are possible. For example, the concepts described herein could also be directly transferred to larger caliber weapons such as tank or howitzers. A laser similar to the current embodiment could also be inserted in rocket propelled grenades or light anti-tank weapons. Another embodiment of this invention might use a micro-switch to complete the circuit when pressed by the close tolerances of the chamber walls.

What is claimed is:

1. A laser aimed cartridge for a firearm, comprising:

(a) a live cartridge capable of launching one or more projectiles at a target when fired from a firearm;

(b) an electromagnetic radiation generating module and a power supply in an electronic circuit within said live cartridge capable of projecting a beam of electromagnetic radiation towards a target to aid in aiming the firearm, wherein said electronic circuit further comprises:

(i) electricity conducting contact strips that extend through said live cartridge and touch metallic chamber walls in a bore of said firearm, and (ii) a normally open tilt switch to create a closed electronic circuit that initiates said beam of electromagnetic radiation when said switch is in a closed position and break said electronic circuit to deactivate said beam when said switch is in an open position; and (c) a non-electrically conducting insert to insulate the electromagnetic radiation generating module, power supply, positional switch and circuitry from metallic portions of the cartridge.

2. The cartridge of claim 1, wherein said cartridge is a shotgun cartridge and said firearm is a shotgun.

3. The cartridge of claim 1, wherein said cartridge is a metallic cartridge having a metallic jacket and said electronic circuit is integral with said one or more projectiles, the electromagnetic radiation generating module, positional switch, and power supply, yet insulated from said metallic jacket.

4. The cartridge of claim 1, wherein said electromagnetic radiation generating module is a laser module.

5. The cartridge of claim 4, wherein said laser module emits a laser that travels through the bore and out a muzzle of the firearm.

6. The cartridge of claim 1, wherein said electromagnetic radiation generating module produces visible light.

7. The cartridge of claim 1, wherein said electromagnetic radiation generating module produces infrared light.

8. The cartridge of claim 1, wherein said power supply is a battery.

* * * * *